US008997411B2

(12) United States Patent
Whitten et al.

(10) Patent No.: US 8,997,411 B2
(45) Date of Patent: Apr. 7, 2015

(54) SAFE ROOM SYSTEM FOR FOLDING ATTIC STAIR ASSEMBLY

(71) Applicants: Josiah Whitten, Schertz, TX (US); Kimberly Whitten, Schertz, TX (US)

(72) Inventors: Josiah Whitten, Schertz, TX (US); Kimberly Whitten, Schertz, TX (US)

( * ) Notice: Subject to any disclaimer, the term of this patent is extended or adjusted under 35 U.S.C. 154(b) by 0 days.

(21) Appl. No.: 13/966,532

(22) Filed: Aug. 14, 2013

(65) Prior Publication Data

US 2015/0047273 A1 Feb. 19, 2015

(51) Int. Cl.

| | |
|---|---|
| ***A46B 13/00*** | (2006.01) |
| ***E04H 9/04*** | (2006.01) |
| ***E04F 11/06*** | (2006.01) |

(52) U.S. Cl.

CPC ..... *E04H 9/04* (2013.01); *E04F 11/062* (2013.01)

(58) Field of Classification Search

CPC ..... E04F 11/064; E04F 11/04; E04F 11/06; E04F 11/062; E04F 11/066

USPC ..... 52/182, 183, 184, 185, 186; 182/77–81

See application file for complete search history.

(56) References Cited

U.S. PATENT DOCUMENTS

| | | | | |
|---|---|---|---|---|
| 476,409 | A | 6/1892 | Rawlings | |
| 2,572,281 | A | 10/1951 | Pierce | |
| 4,541,508 | A | 9/1985 | Lundh | |
| 4,550,534 | A | 11/1985 | Mariano et al. | |
| 6,802,392 | B1 | 10/2004 | Davis | |
| 6,994,184 | B2 | 2/2006 | Latimer et al. | |
| 7,234,203 | B2 | 6/2007 | Latimer et al. | |
| 7,621,374 | B2 | 11/2009 | Richey | |
| 8,272,477 | B1 | 9/2012 | Hudspeth et al. | |
| 2006/0076187 | A1 | 4/2006 | Meza | |
| 2007/0181364 | A1 | 8/2007 | Lair | |
| 2009/0255757 | A1 | 10/2009 | Burke | |
| 2009/0288351 | A1 | 11/2009 | Burke | |
| 2010/0192487 | A1 * | 8/2010 | Thornton et al. | 52/183 |
| 2012/0005972 | A1 | 1/2012 | Burke | |
| 2012/0199417 | A1 * | 8/2012 | Richey et al. | 182/129 |

* cited by examiner

*Primary Examiner* — Mark Wendell

*Assistant Examiner* — Keith Minter

(74) *Attorney, Agent, or Firm* — Kammer Browning PLLC

(57) ABSTRACT

A system and method for establishing a safe room environment within an attic space utilizing a typical folding attic stair and door assembly. The system includes components that retrofit to an existing folding attic stair in a manner that allows the user to draw the attic stair up behind them and to secure the attic door panel closed and locked while the user is within the attic space. The components include a retractable lift cord attached to a middle section of the attic stair, and a lift rod attached to the attic door. Brackets and frames positioned on the attic door and door frame allow the user to pull up to fold and raise the stair into the attic space. A lock may then secure the attic stair closed preventing access from below. Methods for installing the system and using the system are provided.

15 Claims, 7 Drawing Sheets

Fig. 4
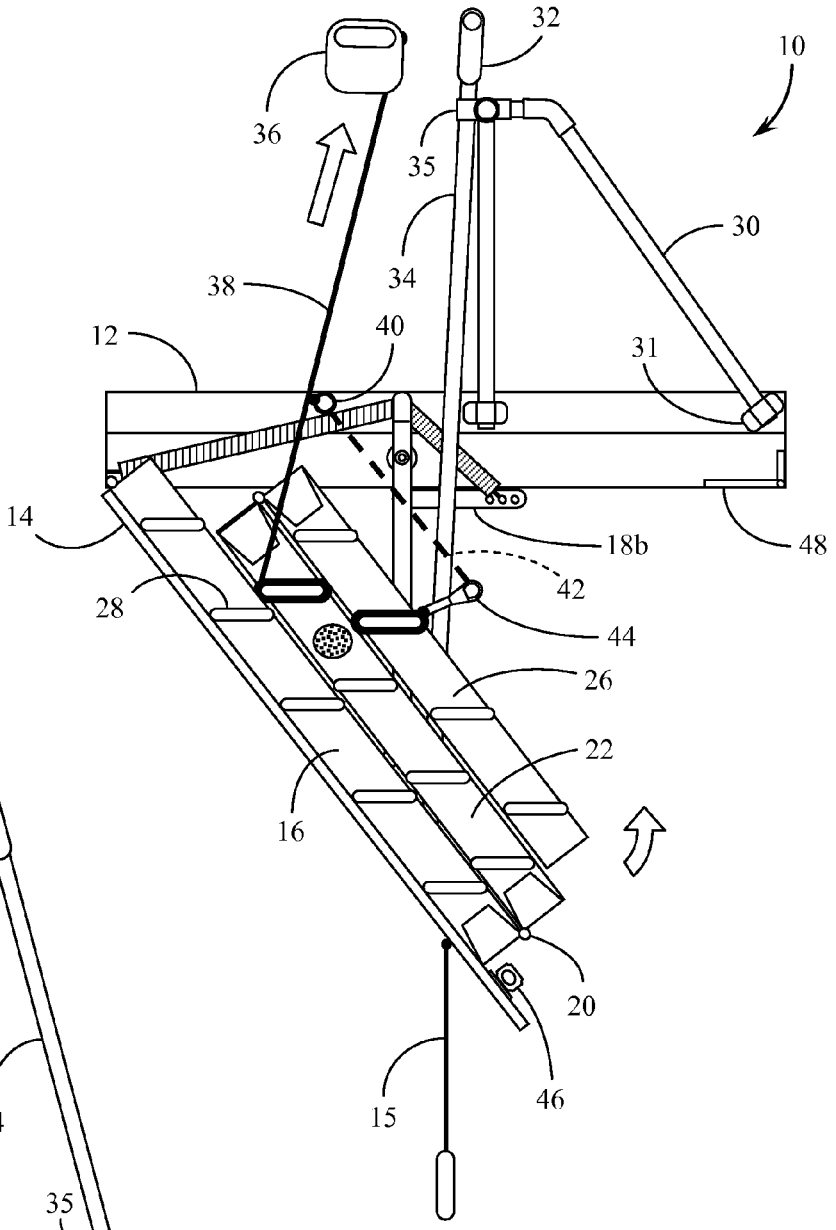
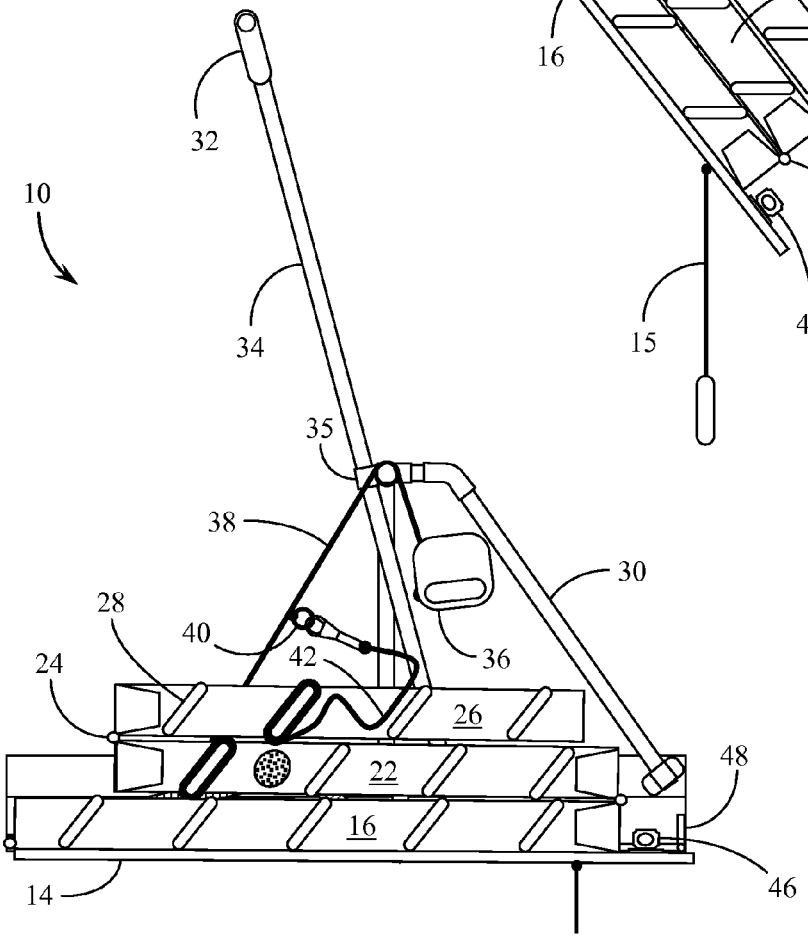
Fig. 5

SAFE ROOM SYSTEM FOR FOLDING ATTIC STAIR ASSEMBLY

BACKGROUND OF THE INVENTION

1. Field of the Invention

The present invention relates generally to systems and methods operable within a residential living environment having an attic with retractable stair access. The present invention relates more specifically to a system and a method for installing and using a safe room environment established within an attic space within a typical residential dwelling.

2. Description of the Related Art

Burglaries and home invasions within residential neighborhoods have become increasingly common. The safety of an individual at home during such a burglary or home invasion can be extremely important. Law enforcement agencies generally recommend that individuals that are at home during a home invasion or an attempted burglary remove themselves from direct contact with the intruders, either by exiting the home or positioning themselves in a locked and safe room within the home. Confronting the intruders, especially by surprise, is generally discouraged.

In many cases, an intruder in a burglary or home invasion is positioned so as to block any exit by the individual at home seeking to distance themselves from the intruder. In many cases, therefore, the only alternative for an individual subjected to a home invasion is to identify a safe location and place themselves in a locked room within a home. While some efforts have been made to create safe room environments within an existing room of the home, such efforts frequently fail because of the obvious ability of the intruder to immediately detect a locked door or other barrier and take steps to either break the door down or otherwise break into the safe room, even if only for the purpose of theft of property.

It would be desirable, therefore, to have a safe room environment within a residential dwelling that is not subject to easy breach by a burglar or other intruder. It would be desirable if such a safe room environment were not immediately apparent to an intruder moving through the home, such as would be apparent when encountering a locked door. It would further be desirable if such a safe room environment were remote from easy access by the intruder.

SUMMARY OF THE INVENTION

The present invention therefore provides a system and method for establishing a safe room environment within an attic space utilizing a typical folding attic stair assembly. The system includes a kit of components that may be retrofit to an existing folding attic stair assembly in a manner that allows the user to draw the attic stair up behind them and to secure the attic door panel closed and locked while the user is within the attic space. The system components include a retractable lift cord preferably attached to the middle section of the folding attic stair, as well as a lift rod attached to the door panel of the attic stair. Brackets and frames positioned on the attic stair door panel and box door frame allow the user to pull up on the attic stair so as to fold and raise the stair into the attic space once the user has positioned themselves in the attic. A locking mechanism positioned on the attic stair door may then secure the attic stair closed, preventing access from below. Methods for installing the system and using the system are provided.

BRIEF DESCRIPTION OF THE DRAWINGS

FIG. 4 is a partial cross-sectional view of the safe room system installation shown in FIG. 1 showing a third stage of the retraction of the system up into the attic.

FIG. 5 is a partial cross-sectional view of the safe room system installation shown in FIG. 1 showing a fourth stage of the retraction of the system up into the attic.

DETAILED DESCRIPTION OF THE PREFERRED EMBODIMENTS

Figure 1:
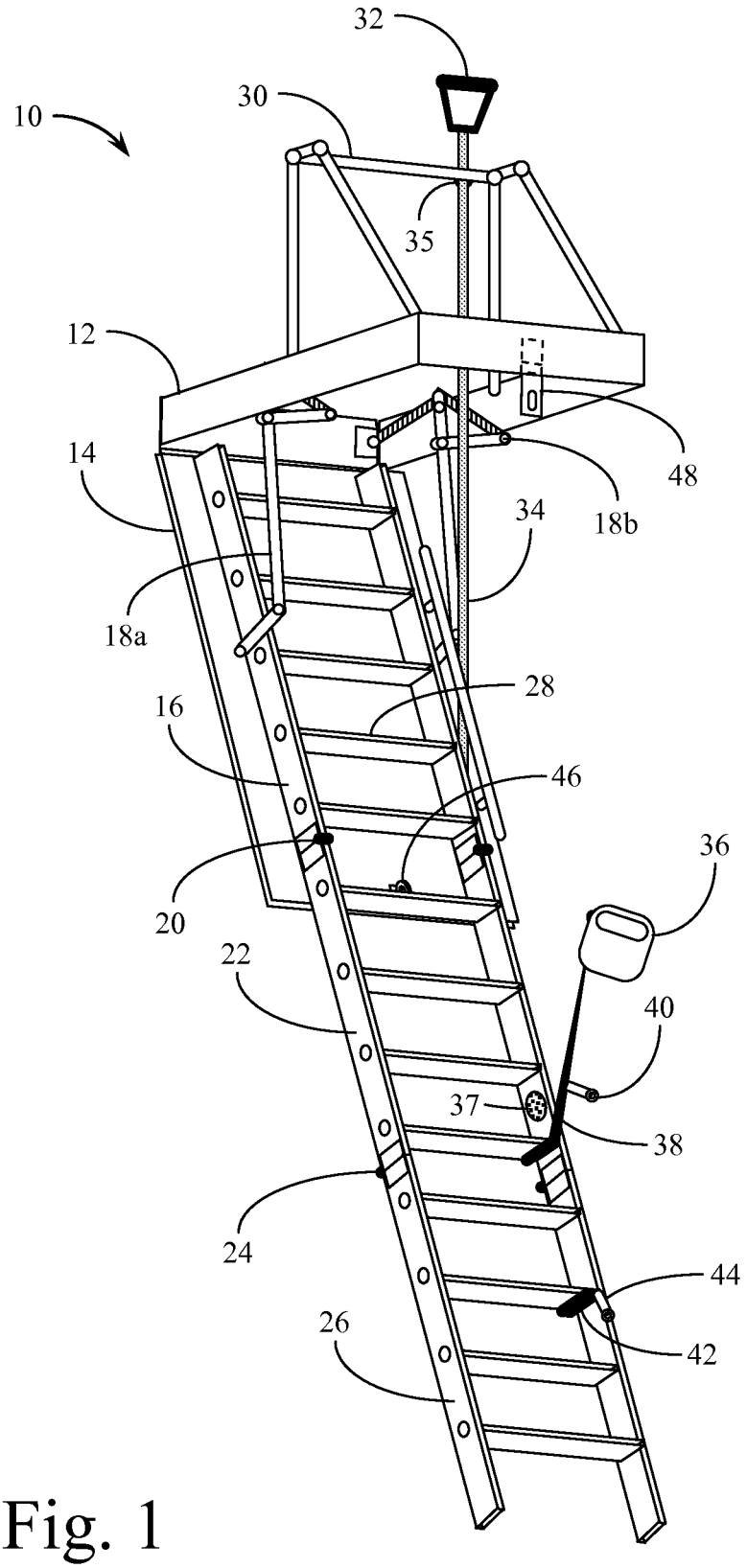
FIG. 1 is a perspective view of the complete safe room system of the present invention installed on a folding attic stair assembly.

Reference is made first to FIG. 1 for an overview of the safe room system of the present invention installed on a typical folding attic stair assembly. Installed system 10 is configured on a typical folding attic stair assembly made up of attic stair box frame 12 and attic stair door panel 14. The stair itself is generally made up of top stair section 16, middle stair section 22, and lower stair section 26. The typical folding attic stair assembly shown incorporates attic stair closure levers 18*a* & 18*b*. These levers connect attic stair box frame 12 with top stair section 16 and pivot in a manner using rigid lever arms connected with heavy duty springs to ease the process of raising and lowering of the attic stair assembly, typically from below.

Connecting top stair section 16 with middle stair section 22 is upper folding hinge 20. In a like manner, connecting middle stair section 22 and lower stair section 26 is lower folding hinge 24. These hinges are arranged on the stair sections in a manner that stacks the stair sections together when collapsed for clearance within a folded position up into attic stair box frame 12. Each of the stair sections 16, 22 & 26 incorporate a number of stair steps 28. The placement of the various components of the safe room system of the present invention, are shown as positioned on the various existing components of the folding attic stair assembly.

Positioned in the attic on attic stair box frame 12 is attic support frame 30 which, in one embodiment of the present invention, comprises a tubular railing structure. Attic support frame 30 is fixed to attic stair box frame 12 to provide a measure of safety for the user when working above the folding attic stair assembly while in the attic, and more importantly providing a point of support for a number of the components of the safe room system once installed on the attic stair assembly. Top section lift rod 34 combined with top section lift handle 32 are slidingly connected to attic support frame 30 at lift rod slide bracket 35. The opposing end of top section lift rod 34 is pivotally attached to attic door panel 14. Top section lift rod 34 and top section lift handle 32 are used to finalize the retraction of folding attic stair assembly as described in more detail below.

Additionally shown in FIG. 1 is retractable lift cord reel 36 incorporating retractable lift cord 38 attached to a stair step positioned on middle stair section 22. At a point close to the loose end of retractable lift cord 38, where it is attached to the step, is positioned connection clip 40. Connection clip 40 is used in conjunction with connection clip 44, and lower section lowering cord 42 in a manner that facilitates the lowering of the folding attic stair assembly after use. Lower section lowering cord 42 is attached to a stair step positioned on lower stair section 26. Also shown on middle stair section 22 is cord reel attachment surface 37 which in the preferred embodiment may comprise a Velcro® type surface mateable with a surface positioned on one side of retractable lift cord reel 36. These attachment surfaces allow retractable lift cord reel 36 to be retained in a position on middle stair section 22 when not in use, and to be easily removed and taken up into the attic space when the system is put to use.

The final installed component of the safe room system of the present invention comprises a door panel lock/latch assembly made up of door panel lock/latch ring 46 positioned on attic stair door panel 14 and box frame lock/latch plate 48 positioned on attic stair box frame 12 as shown. When the folding attic stair assembly is fully retracted into the stowed attic position, the assembly may be locked into place from above utilizing the door panel lock/latch assembly.

Figure 2:
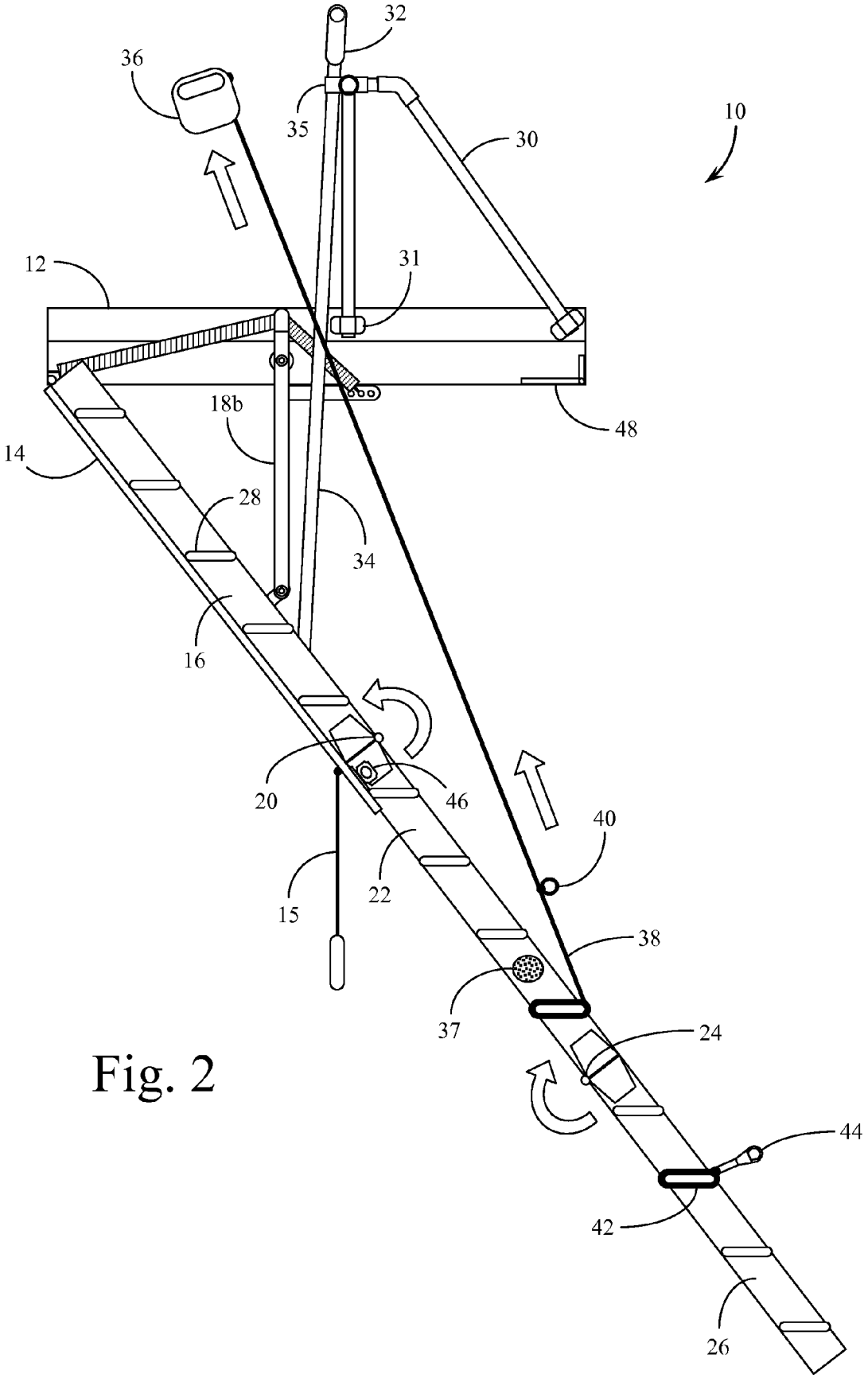
FIG. 2 is a partial cross-sectional view of the safe room system installation shown in FIG. 1 showing a first stage of the retraction of the system up into the attic.

Reference is next made to FIGS. 2-5 for a sequential series of partial cross-sectional views of the system of the present invention showing the manner in which the installed components of the system may operate to raise the folding attic stair assembly to stow (and lock) in its attic position from above rather than from below. FIG. 2 is a partial cross-sectional view of the safe room system installation shown in FIG. 1 demonstrating a first stage of the process of retracting the system up into the attic. FIG. 2 shows the fully extended attic stair assembly as it would typically be positioned for use, whether or not the user intends to take advantage of the safe room capabilities of the system. If the user was simply accessing the attic for other purposes, retractable lift cord reel 36 would remain in place on cord reel attachment surface 37. In contrast, when the user intends to operate the system using its safe room capabilities, the user would ascend the stairs of the attic stair assembly, remove retractable lift cord reel 36 from its position on cord reel attachment surface 37, and carry retractable lift cord reel 36 up into the attic as they ascend the stairs. This process unreels a quantity of retractable lift cord 38 that is stored within retractable lift cord reel 36. In the preferred embodiment of the invention, retractable lift cord reel 36 includes a cord lock feature that allows the user to lock the reel once the cord is extended to the necessary length. This facilitates the lifting of the stair sections as described in more detail below. Various other components of the safe room system as installed on a typical attic stair assembly are the same as those described above in conjunction with FIG. 1. Additional components disclosed in FIG. 2 (not seen clearly in FIG. 1) include support frame attachment straps 31 and attic stair pull cord 15.

Directional arrows positioned at various points in FIG. 2 demonstrate the manner in which the retractable lift cord 38 is pulled up in the process of retracting the system up into the attic and further show the manner in which the stair sections rotate on their respective hinges to be drawn up into a fully collapsed and stacked position (see FIG. 5) for final retraction into the attic space. It is noteworthy that the only action the user must take when intending to use the system for safe room purposes, is to grab the retractable lift cord reel 36 on the way up the stairs before fully arriving into the attic space to initiate the process of retracting the attic stair assembly for closure into the attic.

Figure 3:
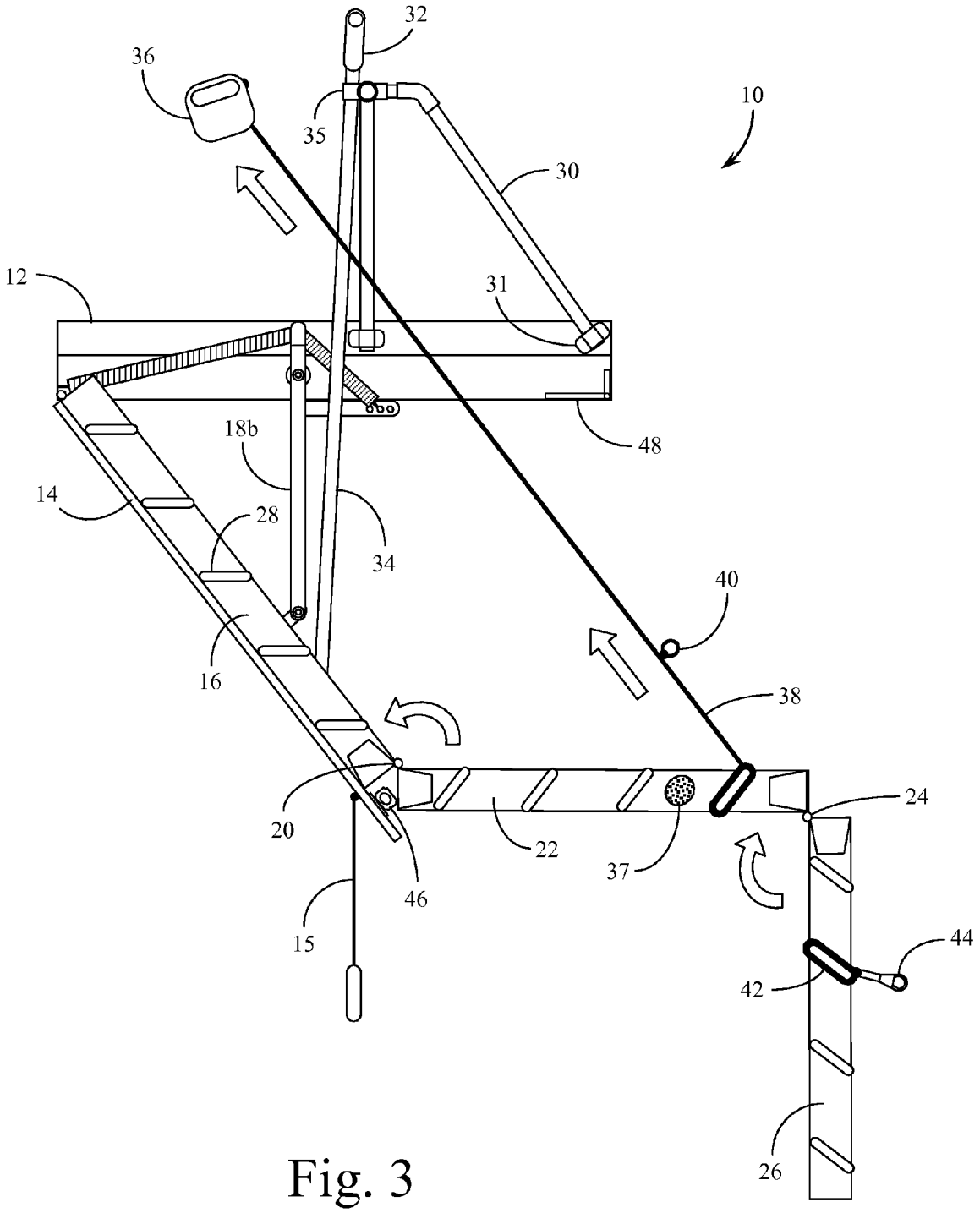
FIG. 3 is a partial cross-sectional view of the safe room system installation shown in FIG. 1 showing a second stage of the retraction of the system up into the attic.

FIG. 3 is the same partial cross-sectional view shown in FIG. 2 demonstrating a second stage of the retraction of the system up into the attic. At this stage, the user has positioned themselves within the attic in a stable position next to attic stair box frame 12 still holding retractable lift cord reel 36. The user activates the cord lock function of the retractable lift cord reel 36 and begins the process of pulling retractable lift cord 38 up into the attic space. This process of pulling retractable lift cord 38 serves to draw up middle stair section 22 by pivoting middle stair section 22 about upper folding hinge 20. In the process of lifting middle stair section 22, lower stair section 26 is lifted off the floor and pivots in the manner shown around lower folding hinge 24 by the force of gravity. At this stage in the retraction process, only middle stair section 22 and lower stair section 26 are in motion with the user drawing these two components up by way of pulling on retractable lift cord 38.

FIG. 4 demonstrates a third stage of the retraction process of the safe room system of the present invention. In FIG. 4 middle stair section 22 and lower stair section 26 have been fully raised to their collapsed position against top stair section 16. This completes the use of retractable lift cord reel 36 and retractable lift cord 38. The user may then release the cord lock function of retractable lift cord reel 36 thereby drawing as much of retractable lift cord 38 back into the cord reel as is necessary to reduce the amount of slack in the cord positioned in the attic space. The user then allows retractable lift cord reel 36 to drape over the top railing of attic support frame 30 for easy access and later use (see FIG. 5 below). The user then turns their attention to the use of top section lift handle 32 connected to top section lift rod 34 positioned within lift rod slide bracket 35. As top section lift rod 34 is pivotally attached to the top of attic door panel 14, its movement will now draw the entire stacked assembly of top stair section 16, middle stair section 22, and lower stair section 26 up into attic stair box frame 12. This is accomplished through the usual rotation of attic stair closure levers 18A & 18B assisted by the tension force of the heavy duty spring associated with the closure levers.

Insofar as top section lift rod 34 is rigid, it will extend up into the attic space above attic support frame 30 as shown in FIG. 5. The travel distance for top section lift rod 34 within lift rod slide bracket 35 is not so great, however, as to extend out of the reach of the user when the stair section is to be once again lowered.

With the attic stair assembly fully retracted into attic stair box frame 12, closing attic stair door panel 14, the user then moves around attic stair box frame 12 to a position where box frame lock/latch plate 48 may be pivoted down onto door panel lock/latch ring 46. In the typical lock/latch assembly, ring 46 may be turn to fully secure the lock/latch components. In this manner, attic stair door panel 14 is locked in place and may not be opened from below. Further security of the lock/latch system may be gained by adding a padlock or other key lock component to the latching mechanism.

The process of lowering of the attic stair assembly is essentially the reverse of the process shown in FIGS. 2-5. Before lowering the stairs, however, the user will initially secure connection clip 44 to connection clip 40 after extending (unwinding) lowering cord 42 from around the step that it is positioned on. With the short length of lowering cord 42 secured at a point on retractable lift cord 38 (dashed line shown in FIG. 4) lower stair section 26 will be lifted slightly by pulling on retractable lift cord 38 after attic stair door panel 14 and the stacked assembly of stair sections has been once again lowered (as shown in FIG. 4) through the use of top section lift rod 34. Once the assembly has been lowered, the user may pull slightly on retractable lift cord 38 and in the process will begin unfolding lower stair section 26 (lifted by lower section lowering cord 42) as well as middle stair section 22 (lifted by retractable lift cord 38). The lowering process then follows in reverse, the position of the stair sections shown in FIG. 3 followed by the position of the stair sections shown in FIG. 2. The user then descends the stairs in the ordinary manner and replaces retractable lift cord reel 36 on its cord reel attachment surface 37 for future use. Retractable lift cord 38 is drawn back into retractable lift cord reel 36 by the force of its internal coil spring. The lowering cord 42 is looped back around the step in the lower stair section 26.

Figure 6:
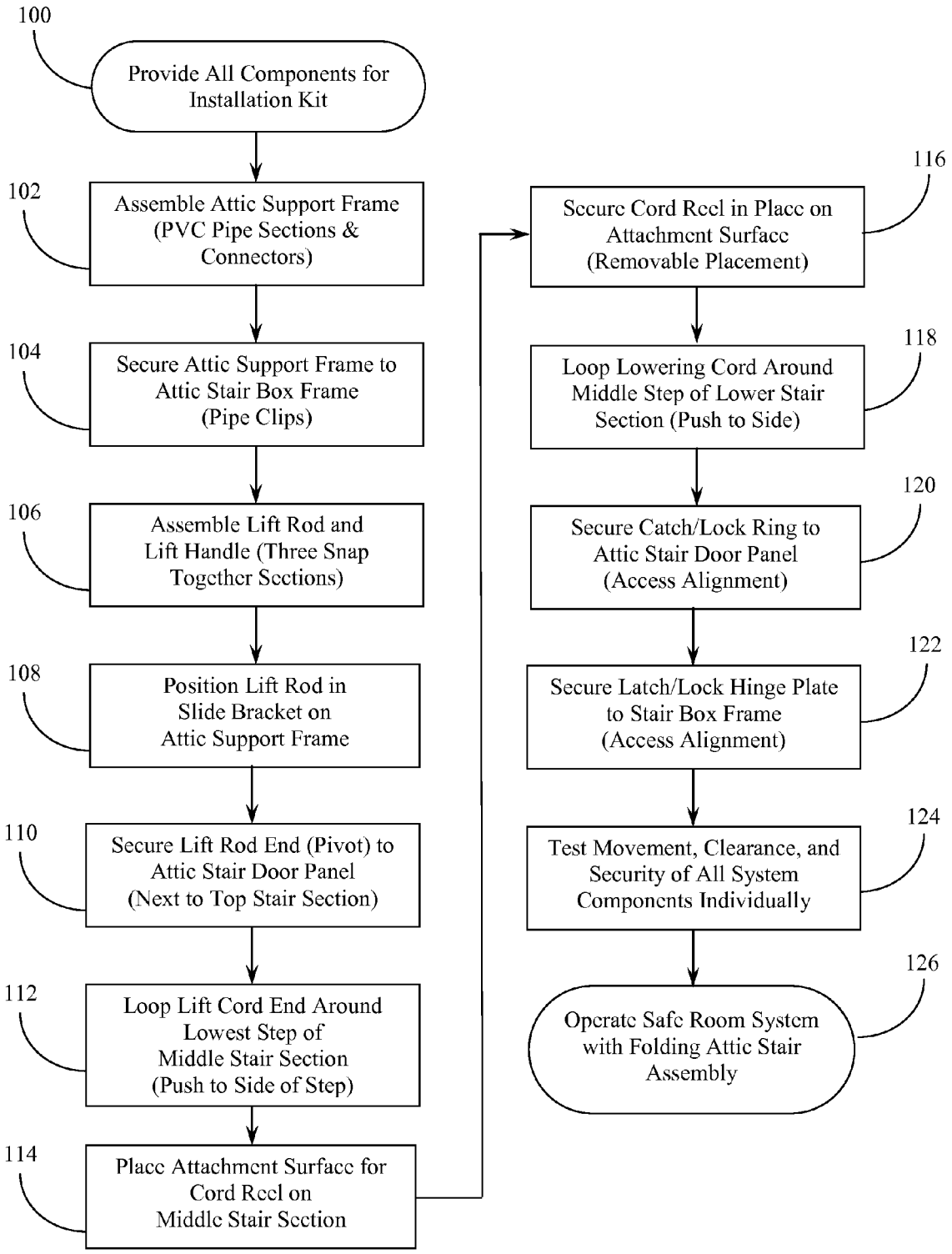
FIG. 6 is a flow chart diagram describing the method of installing the safe room system of the present invention onto a typical folding attic stair assembly.

Reference is next made to FIG. 6 for a detailed description of the manner of installing the components of the safe room system of the present invention. Initially, all components of the installation kit are provided at Step 100. Although the method described in FIG. 6 installs various components in a particular order, those skilled in the art will recognize that installation might proceed in a different order without creating problems with the overall safe and efficient operation of the system. At Step 102 the user assembles the attic support frame prior to its installation in the attic space. In a preferred embodiment of the system of the present invention, the attic support frame comprises PVC pipe sections and connectors or similar aluminum or steel pipe sections and connectors. The frame assembly structure is shown generally in the previous figures. Once assembled, the attic support frame may be positioned in place and secured to the attic stair box frame at Step 104. Various methods of securing the tubular support frame inside the confines of the attic stair box frame will be apparent to those skilled in the art. Pipe clips or similar attachment mechanisms may be used to position attic support frame within the attic stair box frame in a manner that does not interfere with the normal operation (opening and closing) of the folding attic stair assembly.

The user then assembles the lift rod and the lift handle at Step 106. In one preferred embodiment of the present invention, lift rod is made up of three or more snap together sections, one of which may include the lift handle. These snap together sections allow the installation kit to be packaged in a smaller configuration with the longer rigid lift rod components being removably connectable together to form the necessary long rigid rod for operation of the system.

The lift rod as assembled is positioned in the slide bracket on the attic support frame at Step 108. The opposite end of the lift rod is pivotally secured to a point on the top of the attic door panel, preferably nearest the lowest step on the section at Step 110. The lower end of the lift rod is positioned on the outside of the ladder frame component of the top stair section so that it again may be raised into the attic space without interfering with the closure of the overall attic stair assembly.

At Step 112 the retractable lift cord component is secured around the lowest step of the middle stair section and pushed to one side so as not to interfere with the use of the step. The installation kit should include the attachment surfaces for positioning the cord reel on the middle stair section already in place on the cord reel itself. An adhesive film should be removed from the attachment surface that is to be secured to the middle stair section, and at Step 114 should be positioned in place on the inside face of the middle stair section immediately above the step where the lift cord end has been secured at Step 112. At Step 116, therefore, the cord reel itself may be secured in place on the attachment surface by the removable placement of the components associated with the Velcro® like materials.

The lowering cord is looped around and clipped in position on the middle step of the lower stair section at Step 118. This lowering cord is pushed to one side, again to prevent all obstruction with the use of the step. At Step 120 the lock/latch ring assembly is secured to the attic stair door panel aligned in a place that does not interfere with either the raising or lowering of the panel. The installation should be at an accessible location when aligned with the lock hinge plate positioned on the stair box frame. The lock/latch hinge plate is secured at Step 122 to the stair box frame in a manner that aligns with the lock/latch ring positioned on the attic stair door panel.

Once all of the components have been installed as described above, the user should test the movement, clearance, and security of all the system components individually at Step 124. Again, the various straps positioned on the steps should be moved to one side so as to not obstruct use of the steps under normal operation and the cord reel should be securely (but removably) placed at an inside location on the middle stair section where it can be easily removed and carried up into the attic during use. The attic support frame should be secure in its position within the attic stair box frame, as should the lift rod and lift handle assembly positioned thereon. Easy movement of each of these components should be operable (Step 126) by way of the generalized placement of the components as shown in the Drawings.

Figure 7:
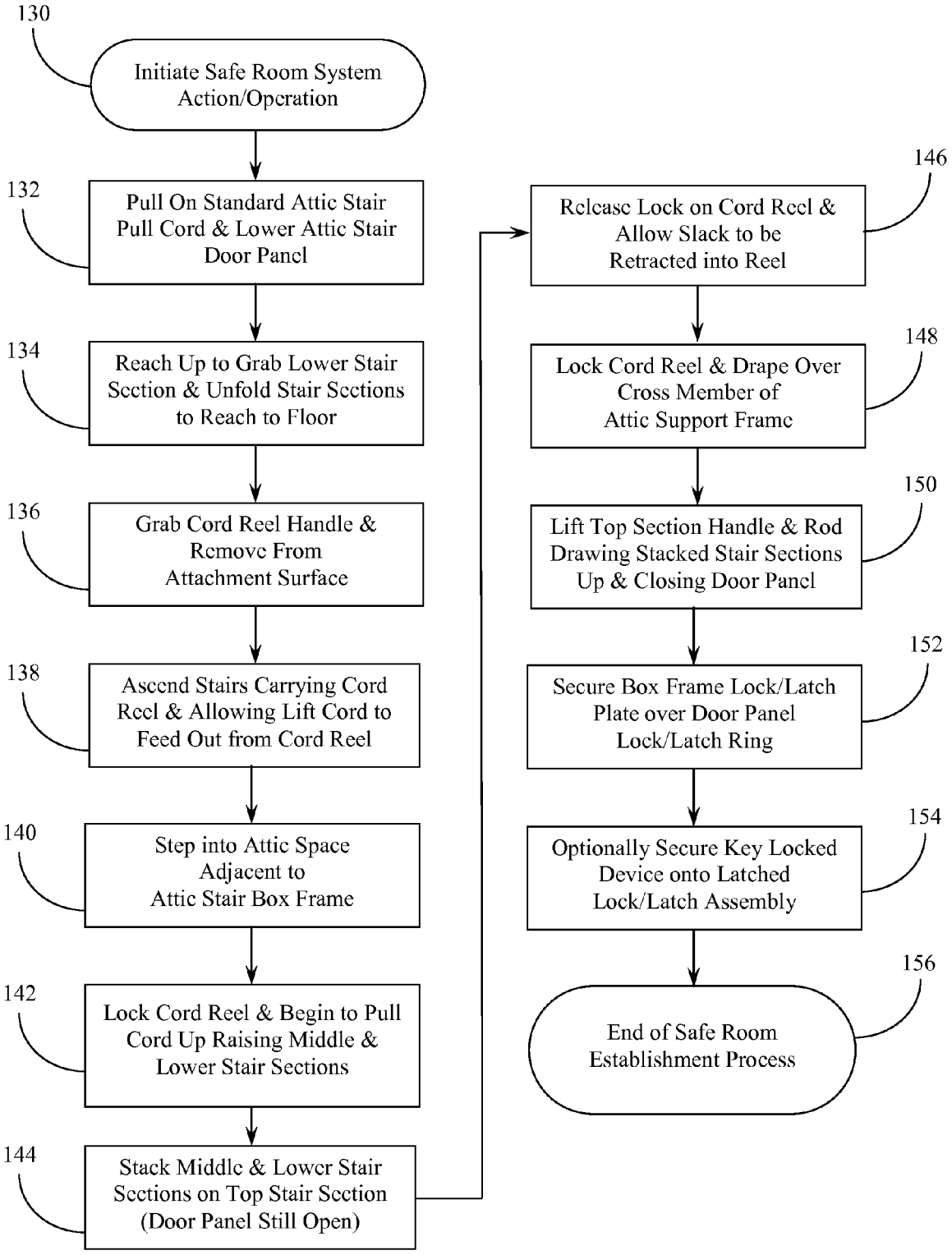
FIG. 7 is a flow chart describing the method of operating and using the installed safe room system of the present invention on a typical folding attic stair assembly to create and enter the safe room environment.

Reference is next made to FIG. 7 for a detailed description of the process of carrying out the safe room system functionality. Initiation of the safe room system action occurs at Step 130 which begins with the user pulling down on the attic stair pull cord and lowering the door panel at Step 132. As typical with attic stair assemblies, the user, at Step 134, then reaches up and unfolds the stair sections to the floor. The user then proceeds up the stairs, grabbing the cord reel handle at Step 136, and removing it from its attachment surface. The user ascends the stairs at Step 138 allowing the lift cord to reel out from the cord reel in the process. The user steps into the attic space at Step 140 and positions themselves next to the stair box frame. At Step 142 the user locks the cord reel and begins to pull up on the cord, raising the middle and lower stair sections.

Step 144 sees the process of stacking the middle and lower stair sections onto their stowed position on top of the top stair section, having pivoted and folded into this parallel orientation, as is typical. At Step 146 the user releases (unlocks) the cord reel and allows the spring loaded function of the cord reel to draw up most of the slack in the cord reel, leaving just enough of the cord extending from the reel to allow the user at Step 148 to again lock the cord reel and drape it over the cross member of the attic support frame.

The user then, at Step 150, switches attention to the top section handle and lift rod and draws the two components up, sliding the rod through the slide bracket attached to the attic support frame. This draws the stacked stair sections up into the attic space and closes the door panel. The user then moves around in the attic space to the side of the attic stair box frame where the lock/latch assembly components are positioned. At Step 152 the user moves the box frame lock/latch plate down over the aligned door panel lock/latch ring and turns the ring to lock and secure the two components together. This prevents the door panel from being pulled open from below. Optionally, at Step 154, the user may secure the lock/latch assembly components with an additional key locked device such as a padlock or other locking mechanism. Those skilled in the art will recognize that other types of two part locking mechanisms may be used in place of the structural lock/latch assembly described herein. This overall process then terminates at Step 156 with the establishment of the safe room environment in the attic space.

Figure 8:
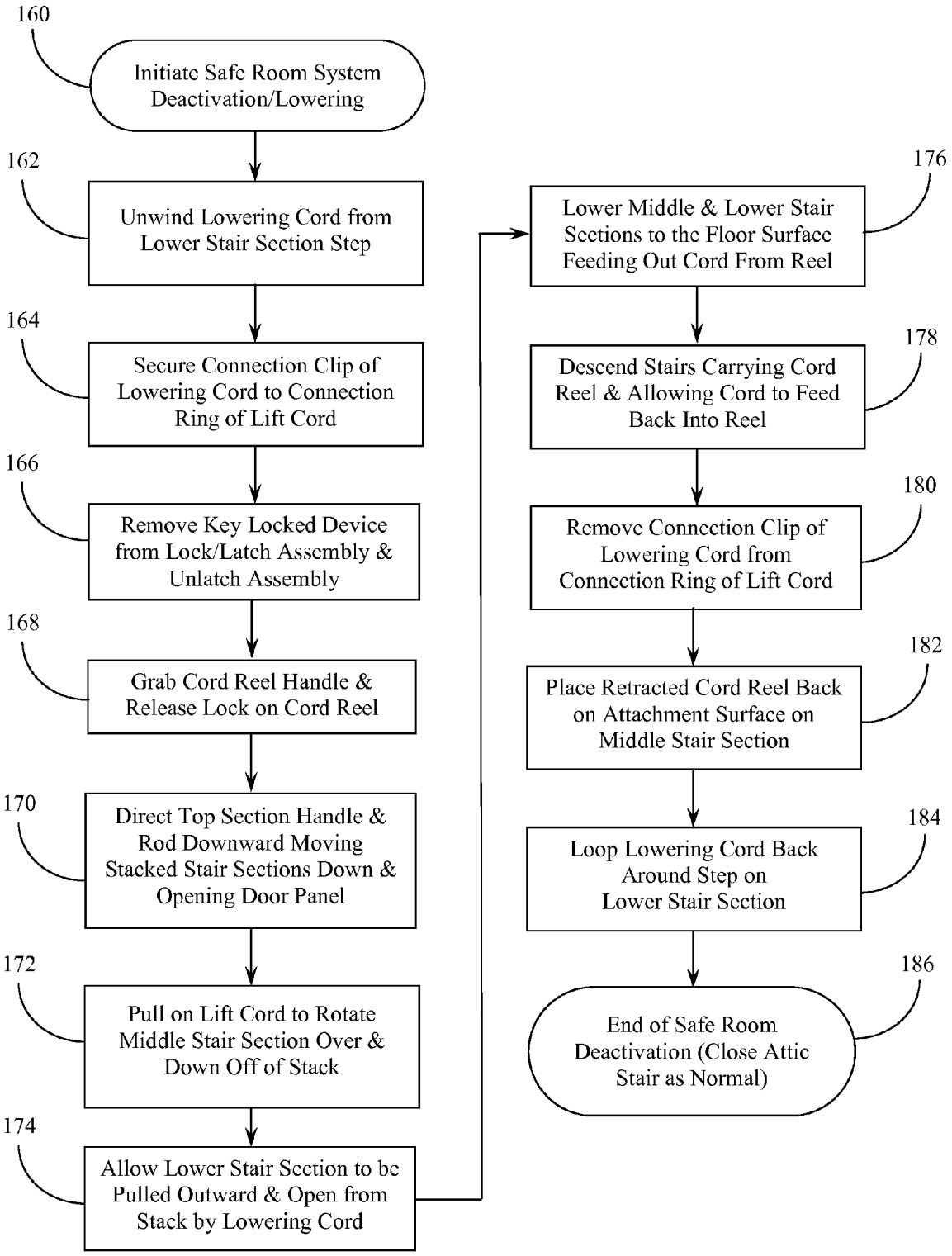
FIG. 8 is a flow chart describing the method of operating and using the installed safe room system of the present invention on a typical folding attic stair assembly to exit from and re-set the safe room environment.

Reference is finally made to FIG. 8 for a detailed description of the manner of releasing and lowering the attic stair assembly once the need for a safe room has terminated. In this process, initiated at Step 160, the user again operates the attic stairs system from a stable position within the attic space. Prior to lowering the stair sections, however, the user unwinds lower section lowering cord, at Step 162, from around the stair step where it is positioned on the lower stair section. Once unwound to its relatively short length, the connection clip on the lowering cord is attached at Step 164 to the connection clip fixed in position on the retractable lift cord. At Step 166, the user unlocks and unlatches the lock/latch ring from the lock/latch plate in essentially the reverse order of the closure method described above.

The user then moves back around to a position above the attic stair box frame where the cord reel may be grasped and unlocked at Step 168 and the top section lift handle and top section lift rod may be pushed downward at Step 170 to lower the stacked assembly of stair sections. The user directs the stacked assembly downward, opening the attic stair door panel by means of pushing downward on the top section lift rod, using the top section lift handle, again, in a manner the reverse of that described above. Once the stacked assembly of stair sections has been lowered to its initial position with the attic stair door panel open (as shown in FIG. 4, for example), the user then retrieves the retractable lift cord reel while maintaining it in its draped position over the attic support frame (to provide friction for ease of lowering) and pulls on it slightly at Step 172 to begin the unfolding of the middle stair section from the top stair section, and further (by way of the attached lowering cord) begin the unfolding of lower stair section from the middle stair section at Step 174. The combined cord attachment system thereby controllably lowers the middle stair section and the lower stair section into their place on the floor at Step 176 as with the initial use of the system (shown in FIG. 2). The user then descends the stairs at Step 178, stands on the floor, removes the lowering cord from its connection to the retractable lift cord at Step 180, and once again (at Step 184) loops it back around the lower section stair step to position it out of the way for normal use of the attic stair assembly. At Step 182, the user replaces the retractable lift cord reel into position on the attachment surface from where it was originally removed. The user thereafter may close the attic stairs at final Step 186, in the same manner as before installation and use of the safe room system.

Although the present invention has been described in conjunction with a number of preferred embodiments, and has been described as being installed on one particular type of attic stair assembly, those skilled in the art will recognize variations in the components of the system that may be made for different attic stair folding structures. Specific placement of the retractable lift cord, as well as the lift rod and handle, are anticipated with variations in the geometry and size of the attic stair. Further variations in the placement and type of the locking mechanism for securing the attic door in place from above are also anticipated. The methods of installation will vary according to the specific components utilized in the establishment of the safe room environment as well as the specific structure and geometry of the attic stair. Such variations dependent upon the structure and geometry of the attic stair, and the attic environment itself, are considered to still fall within the spirit and scope of the invention as defined by the appended claims.

We claim:

1. A system of components for creating a safe room environment within a residence having an attic space, the attic space routinely accessible by way of a multi-section folding attic stair and door assembly, the system of components comprising:

a lift cord having a fixed end secured to a middle section of the folding attic stair assembly and a free end movable into the attic space;

a lift rod having a fixed end pivotally secured to a top section of the folding attic stair and door assembly, and a free end movable into the attic space; and a lock positioned on the attic stair assembly, the lock operable from the attic space to secure the folding attic stair and door assembly in an elevated and closed condition;

wherein after accessing the attic space by way of the multi-section folding attic stair and door assembly, the free end of the lift cord is pulled to fold the stair sections together and the free end of the lift rod is lifted to draw up and close the multi-section folding attic stair and door assembly, where the assembly is secured by the lock.

2. The system of components of claim 1 wherein the lift cord comprises a length of cord removably reeled onto a portable handheld spool, the free end of the lift cord secured to a hub of the spool.

3. The system of components of claim 2 wherein the portable handheld spool of the lift cord further comprises a spool enclosure having a handle, the portable handheld spool further comprising a coil spring with a first end secured to the hub of the spool and a second end secured to the spool enclosure, the coil spring operable to rewind the length of cord back onto the spool after it has been drawn off of the spool.

4. The system of components of claim 3 further comprising first and second mating attachment surfaces, the first mating attachment surface positioned on the spool enclosure and the second mating attachment surface positioned on the middle section of the folding attic stair assembly, the first and second mating attachment surfaces removably securing the spool enclosure and the free end of the lift cord in a user accessible position on the middle section of the attic stair assembly.

5. The system of components of claim 1 wherein the fixed end of the lift cord comprises a closed loop positioned around a step on the middle section of the attic stair assembly.

6. The system of components of claim 1 wherein the folding attic stair assembly includes an attic door panel and the fixed end of the lift rod is pivotally secured to the attic door panel.

7. The system of components of claim 1 further comprising an attic support frame positioned at least partially over the access opening associated with the folding attic stair assembly, the attic support frame comprising a bracket slidingly engaging the free end of the lift rod movable into the attic space.

8. The system of components of claim 7 wherein the attic support frame comprises an assembled framework of connected pipe sections, the framework comprising at least two leg support sections and at least one cross member, the bracket positioned on the at least one cross member.

9. The system of components of claim 1 further comprising a lowering cord having a fixed end secured to a lower section of the folding attic stair assembly and a free end having a releasable connecting clip.

10. The system of components of claim 9 wherein the lift cord further comprises a connecting ring positioned on the lift cord at a fixed distance from the fixed end of the lift cord, the connecting ring connectable to the connecting clip on the free end of the lowering cord.

11. The system of components of claim 1 wherein the lift rod comprises a plurality of end-to-end attachable sections that may be disassembled for compact packaging, the lift rod further comprising a lift handle positioned at the free end of the lift rod.

12. The system of components of claim 1 wherein the lock comprises a first member positioned on the folding attic stair and door assembly and an aligned second member positioned in the attic space.

13. The system of components of claim 12 wherein the first and second lock members comprise a latch and the lock further comprises a padlock attachable to the latch when the first and second lock members are aligned.

14. A method for installing a safe room system on a folding attic stair and door assembly, the safe room environment thereby established within an attic space, the method comprising the steps of:

providing an attic system support frame and assembling the attic system support frame over the attic access opening within the attic space;

providing a multi-part lift rod and assembling the multi-part lift rod;

positioning one end of the assembled lift rod within a slide bracket on the attic system support frame;

pivotally securing a second end of the assembled lift rod to an upper section of the folding attic stair and door assembly;

providing a lift cord and securing a first end of the lift cord on a middle section of the folding attic stair and door assembly;

providing a lowering cord and securing a first end of the lowering cord on a lower section of the folding attic stair and door assembly; and providing a lock mechanism and securing the lock mechanism on the folding attic stair and door assembly adjacent the attic access opening.

15. A method for utilizing a safe room system installed on a folding attic stair and door assembly, the method comprising the steps of:

opening, unfolding, and lowering the folding attic stair and door assembly;

grasping and removing a cord reel attached to the folding attic stair and door assembly and carrying the cord reel up into the attic space while ascending the attic stairs, allowing a lift cord to feed out from the cord reel;

locking the cord reel and lifting on the lift cord, thereby raising a middle and a lower stair section of the folding attic stair and door assembly;

stacking the middle and lower stair sections of the folding attic stair and door assembly on a top stair section positioned on an attic door panel;

lifting the stacked stair sections and the attic door panel, using a lift rod and handle positioned on the attic door panel, thereby closing the attic access opening;

locking the attic stair and door assembly in a closed position within the attic access opening thereby preventing access to the attic space from below;

unwinding a lowering cord from the lower stair section of the folded attic stair and door assembly;

securing a connection clip on the lowering cord to a connection ring on the lift cord;

unlocking the attic stair and door assembly from its position within the attic access opening;

holding the cord reel and directing the handle and lift rod downward, moving the stacked stair sections down and opening the attic access opening;

pulling on the lift cord to rotate the middle stair section over and down off of the stack of stair sections;

allowing the lower stair section to be pulled outward and open from the stack by the connected lowering cord;

lowering the middle and lower stair sections to the floor surface by feeding out cord from the cord reel;

descending the stairs carrying the cord reel and allowing the lift cord to feed back into the reel;

placing the retracted cord reel back on the attachment surface on the middle stair section;

removing the connection clip on the lowering cord from the connection ring on the lift cord; and looping the lowering cord back around the step on the lower stair section.

* * * * *